United States Patent [19]

Lindgren

[11] Patent Number: 4,527,488

[45] Date of Patent: Jul. 9, 1985

[54] COKE OVEN CHARGING CAR

[75] Inventor: Carl Lindgren, Glenshaw, Pa.

[73] Assignee: Koppers Company, Inc., Pittsburgh, Pa.

[21] Appl. No.: 488,776

[22] Filed: Apr. 26, 1983

[51] Int. Cl.[3] ..... B61D 7/06; B61D 7/00; B61D 17/00

[52] U.S. Cl. ..... 105/247; 105/238 R; 105/407

[58] Field of Search ..... 105/238 R, 247, 248, 105/404, 407; 414/162, 163; 202/262; 52/648, 655; 180/327

[56] References Cited

U.S. PATENT DOCUMENTS

| | | | |
|---|---|---|---|
| 718,742 | 1/1903 | Umholtz | 105/247 |
| 941,067 | 11/1909 | Frame et al. | 105/407 |
| 1,553,841 | 9/1925 | Thomas | 105/248 |
| 2,964,147 | 12/1960 | Fentiman | 52/648 |
| 3,957,165 | 5/1976 | Smith | 180/327 |
| 4,250,679 | 2/1981 | Burg | 52/648 |

*Primary Examiner*—Robert B. Reeves
*Assistant Examiner*—Dennis C. Rodgers
*Attorney, Agent, or Firm*—Flehr, Hohbach, Test, Albritton & Herbert

[57] ABSTRACT

A car for charging a coke oven battery with coal. This car carries a plurality of integral coal hoppers. A particular space frame construction is disclosed to support these hoppers, and because of this construction a significant savings in the weight of the car is realized. This space frame includes a pair of horizontally spaced lower front and rear parallel transverse beams and upper front and rear parallel transverse beams. Longitudinally extending beams connect both ends of the upper and lower front transverse beams with the corresponding rear transverse beams. The above described structure is mounted on four wheel housings by means of four truss structures. Two of these wheel housings are positioned slightly in front of the front transverse beams and two are mounted slightly behind the front transverse beams. Each of the front wheel housings is connected to the front transverse beams by means of one of the truss structures, and each of the rear wheel housings is connected to the rear transverse beams by one of the truss structures.

6 Claims, 6 Drawing Figures

COKE OVEN CHARGING CAR

BACKGROUND OF THE INVENTION

1. Field of the Invention

The present invention deals with coke ovens and, in particular, with cars for charging coke ovens with coal.

2. Reference to Related Application

Reference is made to applicant's co-pending application Ser. No. 488,750, filed Apr. 26, 1983.

3. Description of the Prior Art

Coke ovens are conventionally provided with coal by means of coal charging cars which traverse the battery top on tracks. These cars carry a plurality of integral coal containing hoppers, and when the cars are stopped over charging holes in the battery top the contents of these hoppers are released.

Several types of charging cars are known in the art. A common characteristic of the cars heretofore known, however, has been that they are all relatively heavy and cumbersome vehicles that generally rely on a single thick, relatively massive floor-like chassis structure carried on pairs of transversely spaced wheels to support the weight of the car by bending in a vertical direction either between or to the sides of the wheels. Such a car is shown, for example, in U.S. Pat. No. 4,189,272.

Such cars have certain disadvantages. Because of their weight, these vehicles are sometimes difficult to handle and often require relatively large drive means that use relatively large amounts of energy. It is, therefore, the object of the present invention to provide, without sacrificing coke carrying capacity, a coke oven charging car which is lighter and less cumbersome than those currently in use.

SUMMARY OF THE INVENTION

The present invention is a coke oven charging car in which a number of integral coal hoppers are retained in a space frame which includes a pair of horizontally spaced lower front and rear parallel transverse beams and upper front and rear parallel transverse beams. The longitudinally extending beams connect both ends of the upper and lower front transverse beams with the corresponding rear transverse beams. The above described structure is mounted on four wheel housings by means of four truss structures. Two of these wheel housings are positioned slightly in front of the front transverse beams and two are mounted slightly behind the front transverse beams. Each of the front wheel housings is connected to the front transverse beams by means of one of the truss structures, and each of the rear wheel housings is connected to the rear transverse beams by one of the truss structures. By means of the above described arrangement, a considerable savings is achieved in the weight of the charging car.

BRIEF DESCRIPTION OF THE DRAWING

The present invention is further described in the accompanying drawings in which.

DETAILED DESCRIPTION

Figure 1:
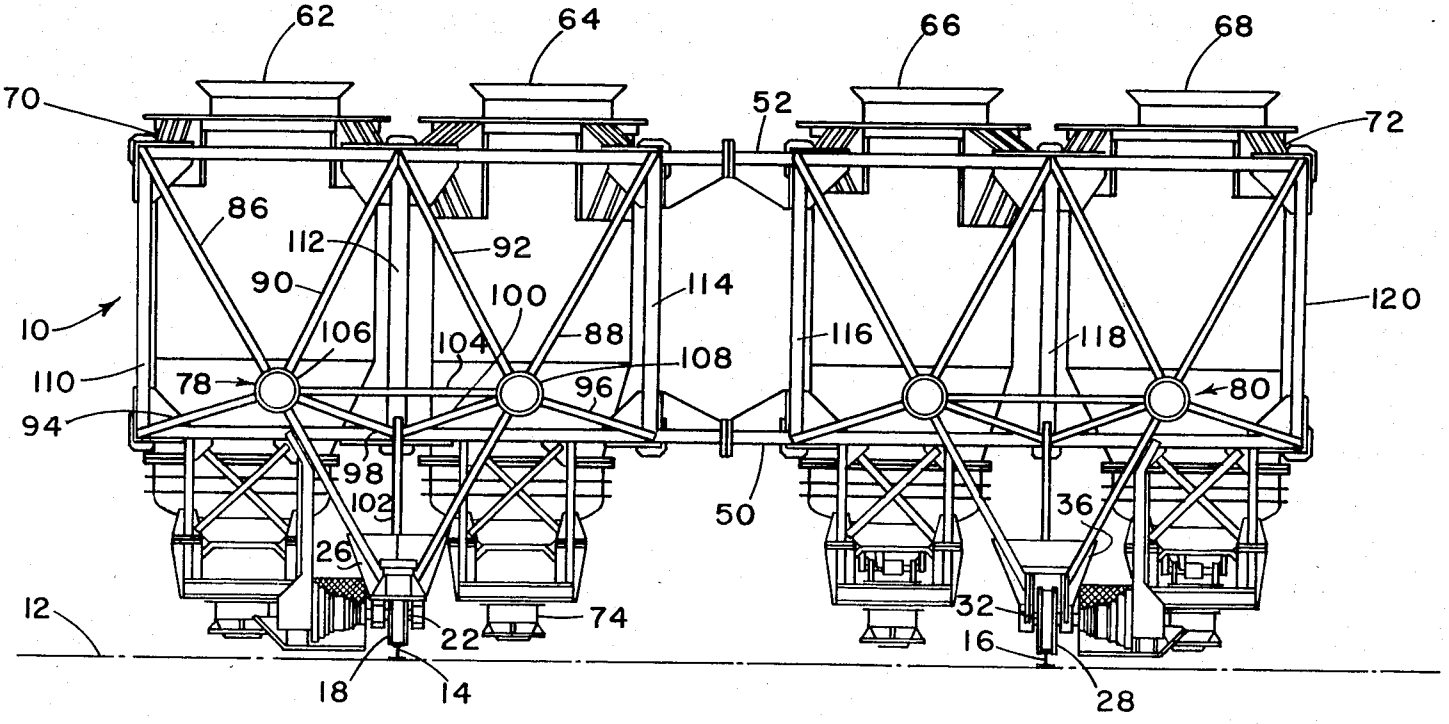
FIG. 1 is a front elevational view of a coke oven charging car representing a preferred embodiment of the present invention.
Figure 2:
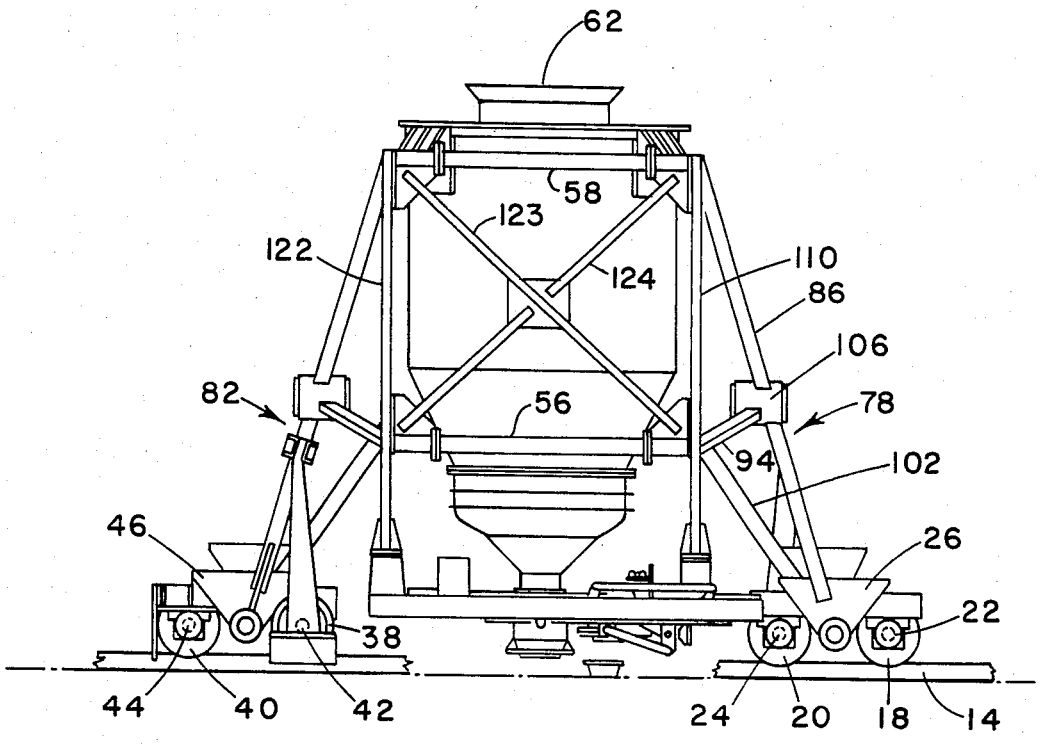
FIG. 2 is a side elevational view of the coke oven charging car shown in FIG. 1.
Figure 3:
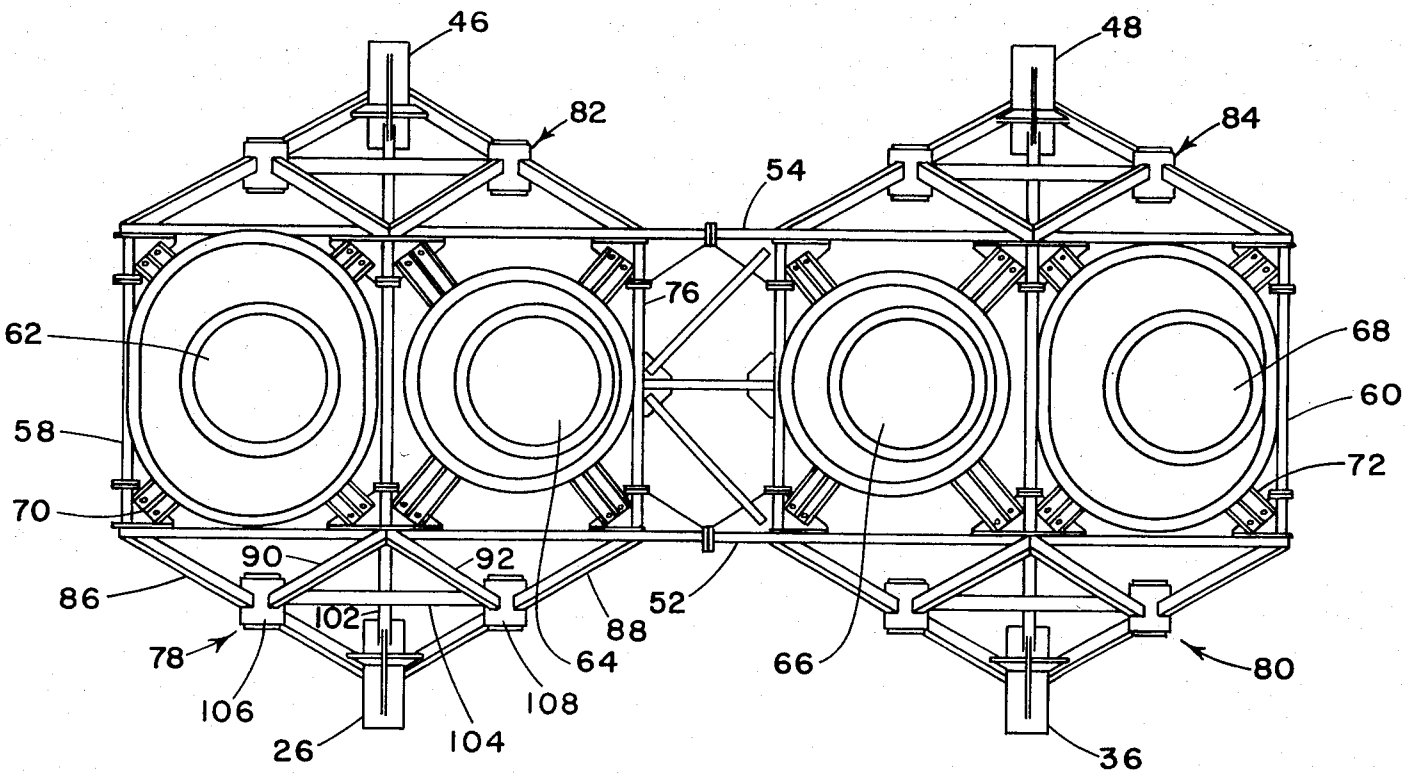
FIG. 3 is a plan view of the coke oven charging car shown in FIG. 1.

Referring to FIGS. 1-3, the coke oven charging car of the present invention is shown generally at numeral 10. This car is mounted on a plurality of wheels to traverse the battery top 12 on rails 14 and 16. Two longitudinally aligned, preferably hydraulically driven front wheels 18 and 20 are mounted respectively on axles 22 and 24 and are retained in front wheel housing 26. Two other longitudinally aligned, preferably hydraulically driven front wheels as at 28 are mounted, respectively, an axles as at 32 and are retained in a second front wheel housing 36 which is laterally spaced from front wheel housing 26.

To the rear of the charging car, longitudinally aligned, preferably hydraulically driven rear wheels 38 and 40 are mounted respectively on axles 42 and 44 and are retained in rear wheel housing 46. On the opposite rear side of the charging car, two other wheels (not shown) are similarly mounted in a second rear wheel housing 48.

An important feature of the present invention is that the charging car is equipped with a space frame structure which includes lower front transverse beam 50, an opposed lower rear transverse beam (not shown), an upper front transverse beam 52 and an upper rear transverse beam 54. This space frame also includes a lower longitudinal beam 56, an opposed lower longitudinal beam (not shown) and two opposed upper longitudinal beams 58 and 60. Positioned between the above mentioned beams are four hoppers 62, 64, 66 and 68. These hoppers are fixed to the above mentioned beams by means of structural members as at 70 and 72 and are equipped, as is conventional, at their lower ends with drop sleeves as at 74. A plurality of intermediate longitudinal beams as at 76 also connect the front and rear transverse beams and are positioned between the hoppers. Connecting the front wheel housing 26 with the upper and lower front transverse beams, there is a front truss structure which is shown generally at numeral 78. A second front truss structure, shown generally at numeral 80, connects the front wheel housing 36 with the upper and lower front transverse beams. To the opposite side of the car two rear truss structures 82 and 84 connect, respectively, the rear wheel housings 46 and 48 with the upper and lower rear transverse beams.

It will be understood that the use herein of the term "truss" will refer not only to those structures in which the loads applied to integral structural members are exclusively tensional or compressive, but also to those structures in which structural members are subject to substantial tensional or compressive forces even though such members may also be transversely loaded or otherwise subject to a bending momemt.

It will be observed that each of these truss structures is similarly constructed. With reference to the front truss structure 78, it will be seen that each of these structures includes a first structural member as at 86. This first structural member is connected at its upper end to the upper front transverse beam 52 (FIG. 3). It extends inwardly toward the longitudinal center line of the car and also extends downwardly and forwardly, to be connected at its lower end to front wheel housing 26. A second structural member as at 88 (FIG. 4) is connected at its upper end on the upper transverse beam 52 and extends outwardly toward the side of the car. Member 88 also extends downwardly and forwardly, to be connected at its lower end to front wheel housing 26. A third structural member as at 90 is connected at its upper end to the upper front transverse beam and extends outwardly, downwardly and forwardly, therefrom, to be connected to the first member 86 at the approximate mid point of the first member. A fourth structural member as at 92 is connected at its upper end to the upper transverse beam at the same place at which the third member 90 is connected. The fourth member 92, however, extends inwardly, downwardly and forwardly to connect medially to the second member 88. A fifth structural member 94 (FIG. 2) is connected at its lower end outwardly on the lower front transverse beam and extends inwardly, upwardly and forwardly, therefrom, to be medially connected, at its other end, to the first member 86. A sixth structural member as at 96 is similarly connected at its lower end inwardly on the lower front transverse beam and extends outwardly, upwardly and forwardly therefrom to medially join the second member 88. A seventh structural member as at 98 is connected at its lower end to the lower front transverse beam at a point midway between the points where the fifth member 94 and the sixth member 96 are connected to that beam. This seventh member extends outwardly, upwardly and forwardly, therefrom, to be connected at its upper end to the first member 86 near the mid point of the first member. An eighth structural member as at 100 (FIG. 1) is connected at its lower end to the lower front transverse beam at the place where the seventh member 98 is connected to that beam. The eighth member 100 extends outwardly, upwardly and forwardly from that point to medially connect with the second member 88 at its other end. A ninth structural member as at 102 is connected at its upper end to the lower front transverse beam and extends downwardly and outwardly, therefrom, to be connected at its lower end to the front wheel housing 26. Finally, a tenth structural member 104 (FIG. 3) connects the mid points of the first member 86 and the second member 88. It will also be seen that the front truss structure 78 includes two tubular connecting members 106 and 108 located, respectively, at the mid points of the first structural member 86 and the second structural member 88. As is explained in greater detail below, the function of these tubular members is to connect the various structural members in the truss structure.

The space frame also includes a plurality of upright columns 110, 112, 114, 116, 118, and 120 (FIGS. 1 & 2) which connect the upper and lower frame transverse beams. Other columns as at 122 also connect the upper and lower rear transverse beams. Referring particularly to FIG. 2, it will be seen that diagonal structural members 123 and 124 also connect the upper and lower longitudinal beams. Two other diagonal structural members (not shown) are similarly positioned on the opposite end of the car.

Figure 4:
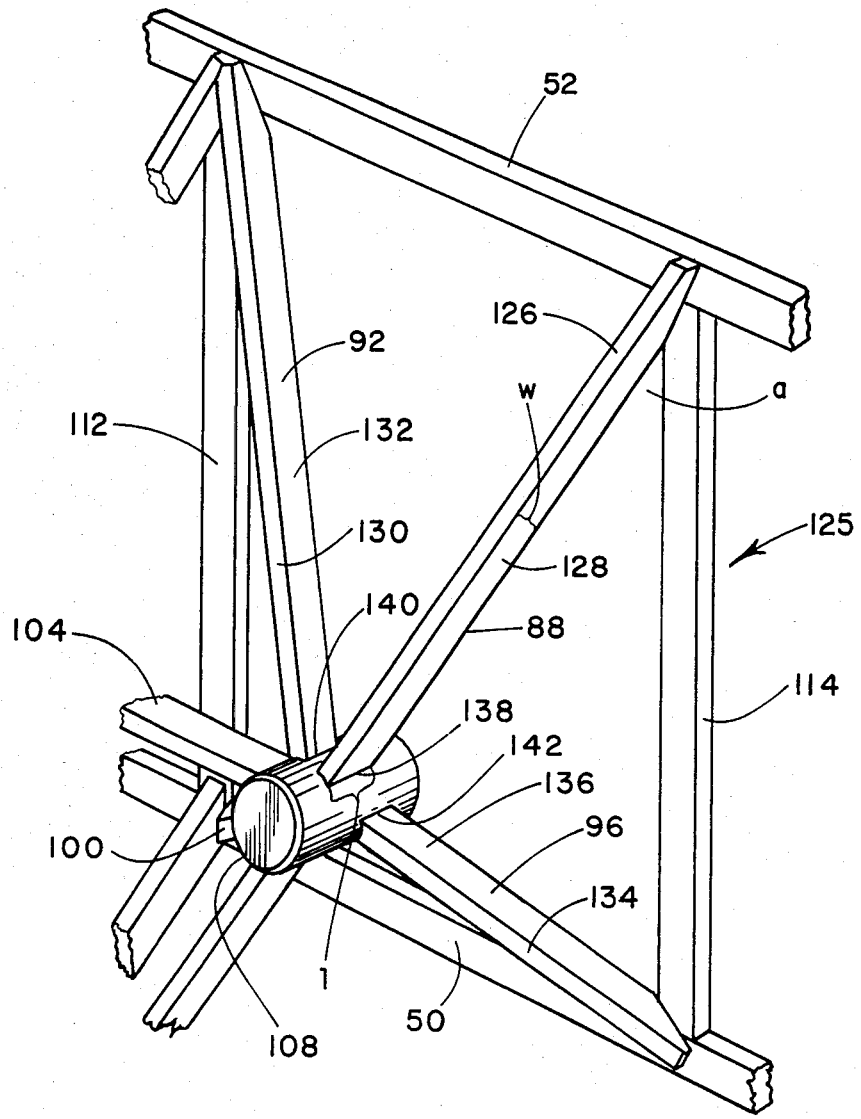
FIG. 4 is an enlarged perspective view of a portion one of the truss structures of the coke oven charging car shown in FIG. 1.

The means by which the tubular connecting members are used to join structural members is shown in greater detail in FIG. 4 which shows the cylindrical shaped tubular connecting member 108 and a part of truss 78. So as to define the position of the tubular connecting member, a planar base structure, shown generally at numeral 125, will be defined. This base structure includes the upper front transverse beam 52, the lower front transverse beam 50, and columns 112 and 114. It will be observed that the abovementioned parts of the base structure share a single vertical plane which is perpendicular to the longitudinal center line of the tubular connecting member 108. It will be noted that structural member 88 projects from the base structure 124 at an acute angle. It will also be seen that the second structural member 88 has a narrowed front side 126, a rear side (not shown) and two wider lateral sides as at 128. The fourth structural member 92, also projects from the base at an acute angle and has a narrow front side 130, a narrow rear side (not shown) and wider opposed lateral sides as at 132. The sixth structural member 96, similarly, has a narrow front side 134 and rear side (not shown) and wider lateral sides as at 136. The eighth member 100 also projects from the base at an acute angle and the tenth member 104 extends from the tubular member 108 in a vertical plane parallel to the base.

It will also be seen that members 88, 92, and 96 are connected at their terminal ends to the tubular member 108. This tubular member is characterized by a plurality of elongated, longitudinal apertures as at 138, 140 and 142 which are angularly displaced from one another on the periphery of the tubular member and are positioned and adapted in size to receive, respectively, members 88, 92 and 96.

Preferably the structural members 88, 92 and 96 are positioned so that their longitudinal center lines may be imaginarily extended to converge at a common point inside the tubular member. This point will be on a line perpendicular to the base 125 which will also be the longitudinal center line of tubular member 108. When the structural members are arranged in this manner, the tubular member will distribute the loads on them as if they were actually all connected at a common point. Thus the structural members would not, from a force analysis perspective, be effectively off set from one another. Accordingly, no bending moments or only small bending moments would ordinarily be introduced into the structure, and in many cases only tensional and compressive loads on the structural members have to be considered in their design. It will, therefore, be appreciated that this structure lends itself to ease of analysis and design. Furthermore, since the structural members carry substantially only tensional or compressive loads and little or no bending loads, these members can be made relatively smaller and lighter than corresponding members in a generally comparable structure in which bending moments are introduced.

The eighth and tenth members are also received in similar apertures (not shown). The lengths of the apertures 138, 140 and 142 will be approximately equal to the length of a section taken respectively through structural members 88, 92 and 96 at the point where the structural member joins the tubular member, where such a section is taken along a plane perpendicular to the base. It will also be appreciated that where the acute angle between the structural member and the base is small, the length of the aperture will be only somewhat greater than the width of the lateral side of the structural member. As the acute angle between the structural member and the base increases, the length of the aperture will increase. A suitable length for the aperture may be calculated by means of the following Formula I where l is the length of the aperture, w is the width of the lateral side of the structural member and a is the angle between the structural member and the base.

$$l=(w/\text{cosine } a) \quad (I)$$

It will also be observed that structural member 88 passes through the tubular member and that its extended portion is retained by means of a fourth aperture (not shown) in the tubular member positioned in opposed relation to aperture 138. From FIG. 4 it will also be seen that structural member 104 extends laterally from another aperture (not shown) in the tubular member. Structural member 100 extends from still another aperture in the tubular member. While not shown in the drawing, it would be possible to fix connecting panels between the structural members to further increase the strength of the structure. For example, a generally triangularly-shaped panel could be positioned to abut beam 52 and structural members 88 and 92 at their edges. Another panel could similarly connect members 88 and 96 and column 114. A third and fourth panel could also be used to connect, respectively, beam 50 and members 96 and 100, and members 92 and 100 and column 112.

Figure 5:
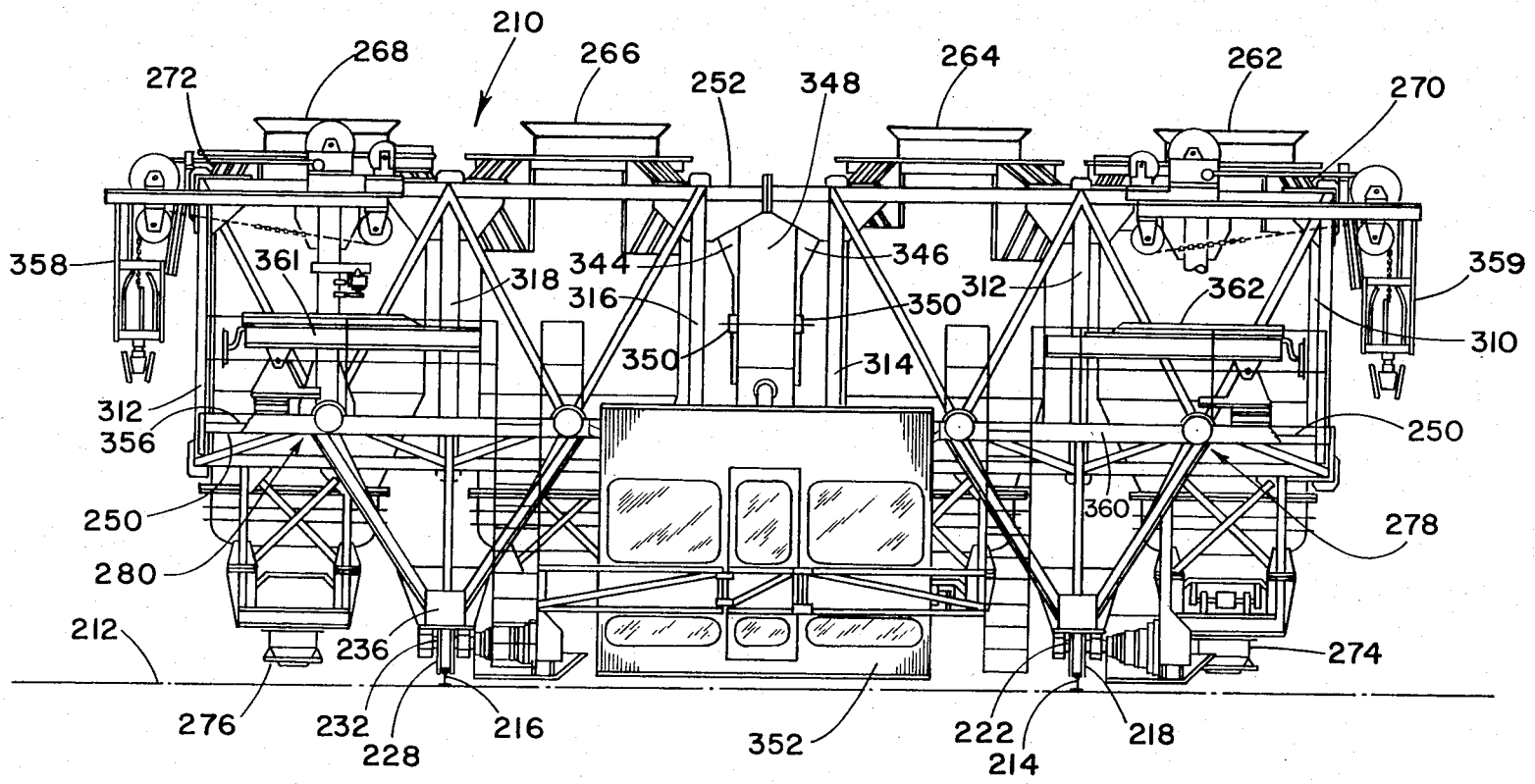
FIG. 5 is a rear elevational view of a coke oven charging car representing another embodiment of the present invention.
Figure 6:
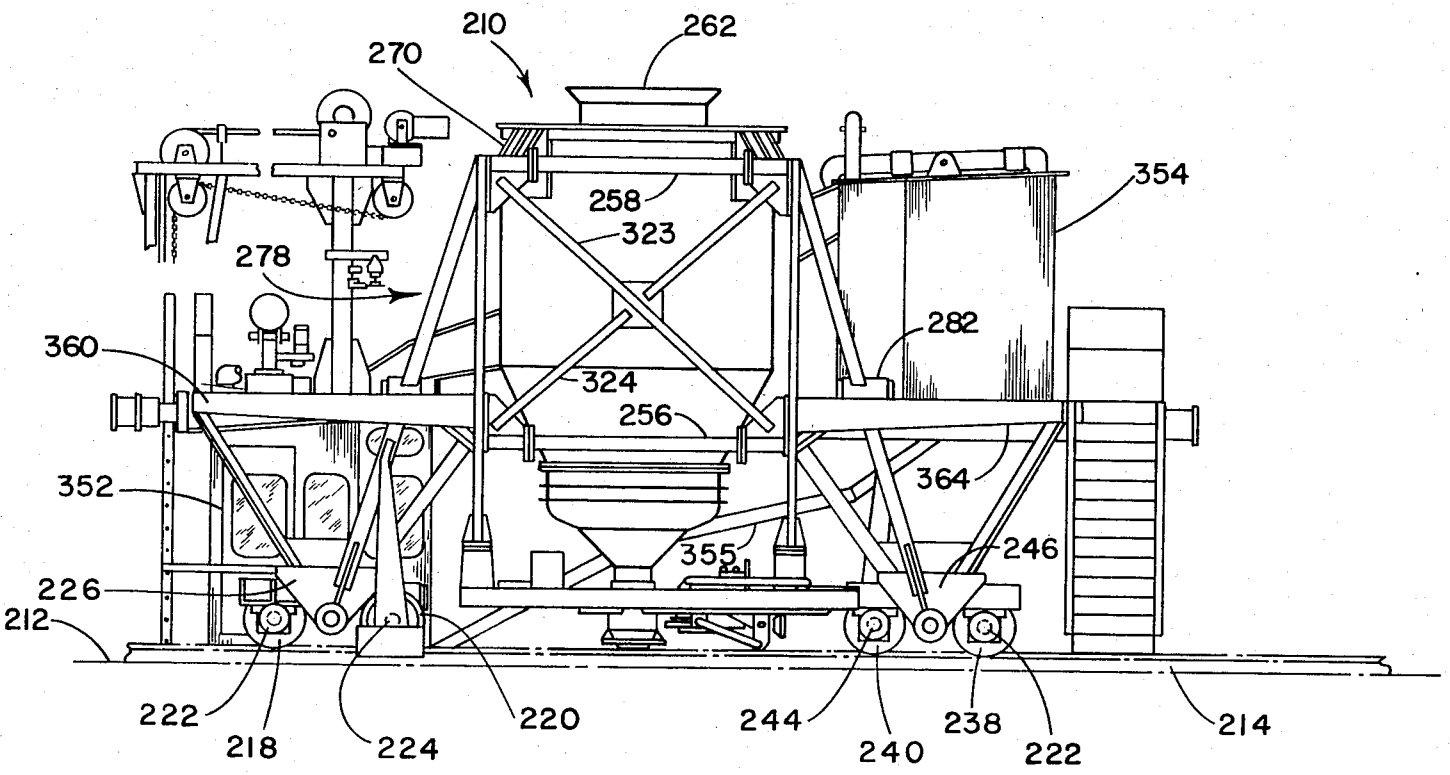
FIG. 6 is a side elevational view in fragment of the coke oven charging car shown in FIG. 5.

Another embodiment of the present invention is shown in FIGS. 5 and 6. In this embodiment a coke oven charging car is shown generally at numeral 210. This car is mounted on a plurality of wheels to traverse the battery top 212 on rails 214 and 216. Two longitudinally aligned, preferably hydraulically driven rear wheels 218 and 220 are mounted, respectively, on axles 222 and 224 and are retained in rear wheel housing 226. Two other longitudinally aligned, preferably hydraulically driven rear wheels as at 228 are mounted, respectively, on axles as at 232 and are enclosed in a second rear wheel housing 236 which is laterally spaced from front wheel housing 226.

To the front of the charging car, longitudinally aligned, preferably hydraulically driven front wheels 238 and 240 are mounted respectively on axles 242 and 244 and are retained in front wheel housing 246. On the opposite front side of the charging car, two other wheels (not shown) are similarly mounted in a second front wheel housing (not shown).

As with the first embodiment, this car is also equipped with a space frame which includes lower rear transverse beam 250, an opposed lower front transverse beam (not shown), an upper rear transverse beam 252 and an upper front transverse beam (not shown). This space frame also includes a lower longitudinal beam 256, an opposed lower longitudinal beam (not shown) and two opposed upper longitudinal beams as at 258. Positioned between the above mentioned beams are four hoppers 262, 264, 266 and 268. These hoppers are fixed to the above mentioned beams by means of structural members as at 270 and 272 and are equipped, as is conventional, at their lower ends with drop sleeves as at 274. Intermediate longitudinal beams (not shown) are provided between the hoppers to connect the front and rear transverse beams. Connecting the rear wheel housing 226 with the upper and lower front transverse beam, there is a rear truss structure which is shown generally at numeral 278. A second rear truss structure, shown generally at numeral 280, connects the rear wheel housing 236 with the upper and lower rear transverse beams. To the opposite side of the car two rear truss structures as at 282 connec the rear wheel housing as at 246 with the upper and lower front transverse beams. Each of these truss structures is constructed in a manner similar to truss structure 78 which is described above in connection with the first embodiment.

The space frame also includes a plurality of upright structural members or columns 310, 312, 314, 316, 318 and 320 which connects the upper and lower rear transverse beams. Other columns as at 322 also connect the upper and lower front transverse beams. Referring particularly to FIG. 6, it will be seen that diagonal structural members 323 and 324 also connect the upper and lower longitudinal beam. Two other diagonal structural members are similarly positioned on the opposite end of the car.

A pair of support members 344 and 346 are also suspended from the upper front and rear transverse beams 252 and 254. A moveable beam 348 is pivotally mounted on these support members at bearing 350 so that the front and rear sides of this beam move in vertical arcs. An operator's control cab 352 is suspended from the rear terminal end of the moveable beam 348. A housing room 354 for electrical and hydraulic equipment is suspended from the front end of the moveable beam 348. The control cab 352 is also connected with the housing room by means of a linkage 355. As the moveable beam 348 is pivoted on bearing 350, the control cab 352 is raised or lowered so as to improve the operator's visibility. Car 210 is also equipped with a platform 356 on which ascension pipe cleaners 358 and 359 are mounted. Additionally, it is equipped with a platform 360 on which elbow pipe cleaners 361 and 362 are mounted. Platform 364 and another opposed platform (not shown) are also provided on the front side of the car.

It will be appreciated that there has been described a coke oven charging car which is significantly lighter and less cumbersome than those which have been heretofore conventionally used.

Although the invention has been described herein with a certain degree of particularlity, it is to be understood that the present disclosure has been made only as an example and that the scope of the invention is defined by what is hereinafter claimed.

What is claimed is:

1. A coke oven charging car comprising:

(a) first and second laterally spaced front wheel housings, each of said front wheel housings being carried by one or more wheels mounted on axles to be moveable in a forward or rearward direction;

(b) first and second laterally spaced rear wheel housings, each of said rear wheel housings being carried by one or more wheels mounted on axles to be moveable in a forward or rearward direction;

(c) lower front and rear parallel transverse beams longitudinally spaced from one another and interposed between said front and rear wheel housings;

(d) upper front and rear parallel transverse beams longitudinally spaced from one another and vertically spaced above and superimposed, respectively, over said lower front and rear parallel transverse beams;

(e) a pair of lower laterally spaced longitudinal beams connecting said lower front and rear transverse beams;

(f) a pair of upper laterally spaced longitudinal beams connecting said upper front and rear transverse beams;

(g) at least one gravity operated, bottom discharging hopper interposed between said upper and lower front and rear transverse beams;

(h) first and second front truss structures interconnecting, respectively, the first front wheel housing and the upper and lower front transverse beams and the second front wheel housing and the upper and lower front transverse beams; and (i) first and second rear truss structures interconnecting, respectively, the first rear wheel housing and the upper and lower rear transverse beams and the second rear wheel housing and the upper and lower rear transverse beams, at least one of said truss structures comprising:

(1) a first member connected at its upper end outwardly on the upper front transverse beam and extending inwardly and downwardly therefrom to be connected at its lower end to the first front wheel housing;

(2) a second member connected at its upper end inwardly on the upper front transverse beam and extending outwardly and downwardly therefrom to be connected at its lower end to the first front wheel housing;

(3) a third member connected to the upper front transverse beam at its upper end between said first and second members and extending outwardly and downwardly therefrom to be medially connected to the first member;

(4) a fourth member connected to the upper front transverse beam at its upper end between said first and second members and extending inwardly and downwardly therefrom to be medially connected to the second member;

(5) a fifth member connected at its lower end outwardly on the lower front transverse beam and extending inwardly and upwardly, therefrom, to be medially connected to the first member;

(6) a sixth member connected at its lower end inwardly on the lower front transverse beam and extending outwardly and upwardly therefrom to be medially connected to the second member;

(7) a seventh member connected at its lower end to the lower front transverse beam between said fifth and sixth members and extending outwardly and upwardly, therefrom, to be medially connected to the first member at its upper end;

(8) an eighth member connected at its lower end to the lower front transverse beam between said fifth and sixth members and extending outwardly and upwardly therefrom to be medially connected to the second member at its upper end;

(9) a ninth member connected at its upper end to the lower front transverse beam and extending downwardly, therefrom, to be connected to the first wheel housing; and

(10) a tenth member connecting medially at its one end to the first member and connecting medially at its other end to the second member.

2. A coke oven charging car as defined in claim 1 wherein the first member is connected to the upper front transverse beam at a first point that is vertically spaced above a second point where the fifth member is connected to the lower transverse beam, and the second member is connected to the upper front transverse beam at a third point that is vertically spaced above a third point where the sixth member is connected to the lower transverse beam, and the third and fourth members are jointly connected to the upper transverse beam at a fifth point which is vertically spaced above a sixth point where the seventh, eighth and ninth members are jointly connected to the lower transverse beam.

3. The coke oven charging car as defined in claim 2 wherein first, second and third columns connect, respectively, the first and second points, the second and third points and the fifth and sixth points.

4. The coke oven charging car as defined in claim 3 wherein the third, fifth, seventh and tenth members are connected to the first member at a common seventh point and the fourth, sixth, eighth and tenth members are connected to the second member at a common eighth point.

5. A coke oven charging car for operating on spaced rails of a trackway, the car comprising:

(a) two first and second front and two first and second rear carriage assemblies, each assembly including rail engaging wheels and a housing carried by the wheels;

(b) a structural framework extending transversely of the rails, forming laterally spaced regions for accommodating coal carrying hoppers, both the forward and rear sides of the framework comprising transversely extending and vertically spaced structural beams, upright structural column members extending between the forward upper and lower transverse beams and between the rear upper and lower transverse beams, and structural beams extending longitudinally between the two upper and two lower transverse beams between the hopper accommodating regions, whereby the transverse beams and vertical beams on each of the forward and rear sides of the framework embrace rectangular areas that face the hopper accommodating regions;

(c) bottom discharging hoppers disposed in said regions and secured to the framework; and (d) structural truss means for supporting the framework on the housings of the carriages, said means comprising:

(1) truss structures disposed on the front and rear sides of the framework, each structure being disposed adjacent and extending across one of said rectangular areas, each of the truss structures comprising a plurality of rectilinear structural members, one end of each such members being secured to the framework at points adjacent to each of the corners of the corresponding rectangular area, and a single connecting member to which the other ends of the structural members of the truss structure are secured, said structural members of the truss being disposed at acute angles to the said corresponding rectangular area and extending radially from the connecting member; and (2) rectilinear structural members secured to and extending from the housings of the carriages and secured to said truss connecting members whereby the load represented by the framework and hoppers is carried by said last named structural members and the truss structures.

(3) the framework being dimensioned to provide four of said regions with each region accommodating a coal hopper, and two load bearing structural members extending from each housing to the connecting members of two adjacent truss structures.

6. A coke oven charging car as in claim 5 in which the connecting members of two adjacent truss structures are directly connected to the ends of a transverse structural member.

* * * * *